US006880527B2

(12) United States Patent
Magel

(10) Patent No.: US 6,880,527 B2
(45) Date of Patent: Apr. 19, 2005

(54) FUEL INJECTION DEVICE

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,071

(22) PCT Filed: Apr. 27, 2002

(86) PCT No.: PCT/DE02/01550

§ 371 (c)(1),
(2), (4) Date: Sep. 8, 2003

(87) PCT Pub. No.: WO02/093001

PCT Pub. Date: Nov. 21, 2002

(65) Prior Publication Data

US 2004/0025843 A1 Feb. 12, 2004

(30) Foreign Application Priority Data

May 17, 2001 (DE) ..... 101 23 913

(51) Int. Cl.[7] ..... F02M 41/00
(52) U.S. Cl. ..... 123/467; 123/447
(58) Field of Search ..... 123/467, 447, 123/446; 239/88, 89, 91, 533.2, 533.3, 533.9, 585.1, 585.5

(56) References Cited

U.S. PATENT DOCUMENTS 6,634,336 B1 * 10/2003 Kropp ..... 123/467

FOREIGN PATENT DOCUMENTS

| | | | |
|---|---|---|---|
| DE | WO 0133067 | * | 5/2001 |
| RU | 2074975 C1 | * | 12/1992 |
| RU | 2078244 C1 | * | 3/1995 |

* cited by examiner

*Primary Examiner*—Mahmoud Gimie
(74) *Attorney, Agent, or Firm*—Ronald E. Greigg

(57) ABSTRACT

A fuel injection system for internal combustion engines includes an injector supplied from a high-pressure fuel source and with a pressure booster device, in which the closing piston can be acted upon by fuel pressure to attain a force exerted on the closing piston in the closing direction, and in which the closing pressure chamber and the return chamber of the pressure booster device are formed by a common closing pressure return chamber, and all the portions of the closing pressure return chamber communicate with one another permanently for exchanging fuel, so that despite a low pressure boost by the pressure booster device, a relatively low injection opening pressure is attainable.

20 Claims, 10 Drawing Sheets

FUEL INJECTION DEVICE

CROSS-REFERENCE TO RELATED APPLICATIONS

This application is a 35 USC 371 application of PCT/DE 02/01550 filed on Apr. 27, 2002.

BACKGROUND OF THE INVENTION

1. Field of the Invention

The invention is directed to an improved fuel injection system for internal combustion engines, including a pressure booster between the fuel injector and a high pressure fuel source.

2. Description of the Prior Art

From German Patent Disclosure DE 43 11 627, fuel injection systems are already known in which an integrated pressure booster piston, by means of filling or evacuating a return chamber, makes it possible to increase the fuel injection pressure above the value furnished by a common rail system.

From U.S. Pat. No. 6,113,000, an injection system is known that has a high-pressure reservoir and a medium-pressure reservoir; the high-pressure reservoir can selectively also be filled with fuel.

German Patent Disclosure DE 199 10 970 describes fuel injection systems with pressure boosters, in which the injector and the pressure booster are each assigned a separate control valve.

German Patent Disclosure DE 43 11 627 also describes an injection system which requires not only a control valve but also an additional four-position slide valve.

SUMMARY OF THE INVENTION

The fuel injection system of the invention has the advantage over the prior art that, as a pressure-controlled device using pressure booster devices with a low pressure boosting ratio, for instance on the order of magnitude of 1:1.5 to 1:3, it achieves relatively low injection opening pressures. A low pressure boosting ratio is advantageous since as a result the installation space for the injector or pressure booster can be kept small; because of the small volumes, highly dynamic pressure buildup and reduction are achieved; depressurization losses are reduced to a minimum; the volumetric flows in the system and the supply quantity of a fuel pump remain low; and the requisite pressure level in the pump and rail, even at high injection pressures of over 2000 bar, remains in the range of up to 1400 bar that has already been mastered by now in mass production. The volumetric flows in the low-pressure system also remain slight. The disposition according to the invention makes it possible also to exploit these advantages for applications in which small fuel quantities must be metered reliably. This is attained by a relief of the closing pressure chamber at precisely the moment when the injection of fuel is to occur. A low boosting ratio can thus be achieved, without causing the opening pressure to assume excessively high values that would make exact metering of small fuel quantities impossible. Moreover, a high closing pressure is assured, which leads to rapid needle closure at high injection pressure. It is especially advantageous that at least the fuel pressure of the high-pressure fuel source can prevail constantly (aside from pressure fluctuations occurring in the system) in the high-pressure chamber. This advantageously assures that at the very first moment when the injector opens, a high injection pressure prevails at the injection openings, and fuel can be metered to the combustion chambers in exact dosages within small time slots. Furthermore, the design of the pressure booster can be made simple and sturdy, since besides the low-pressure system, there is only one further fuel system with higher fuel pressure.

If the function of the pressure chamber of the injector is taken on by the high-pressure chamber of the pressure booster device, the result is a reduced idle volume downstream of the pressure booster device that still has to be compressed to high pressure. Moreover, the amplitude of any fluctuations that occur between the closing pressure chamber and the pressure chamber is lessened, since a shorter flow connection from the closing pressure chamber to the pressure chamber results. The overall result is a more-reliable mode of operation, with the capability of faster switching.

In a further advantageous embodiment with a diametrically opposed disposition of the line orifices into the chambers of the pressure booster device and/or of the closing pressure chamber, it can be attained that there is a constant flow through the chambers during operation. Especially at small injection quantities, it is thus also assured that the chambers have a flow through them continuously. As a result, local overheating of the fuel in the chambers from constant compression and depressurization can be avoided, along with component damage. Moreover, this prevents dirt from being able to collect in the chambers.

BRIEF DESCRIPTION OF THE DRAWINGS

Exemplary embodiments of the invention are explained in further detail in the ensuing description, taken in conjunction with the drawings, in which.

DESCRIPTION OF THE PREFERRED EMBODIMENTS

Figure 1:
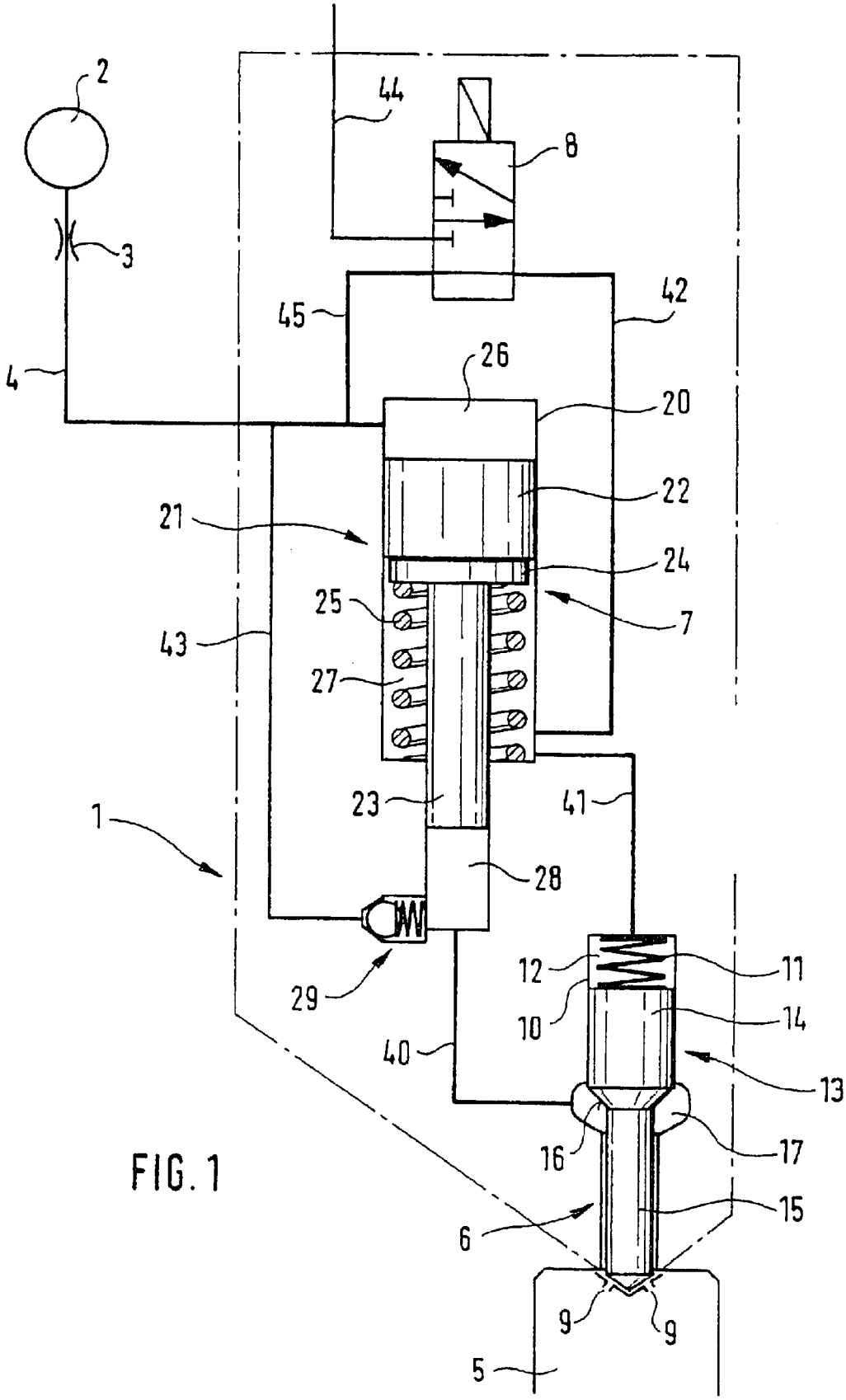
FIG. 1 shows a fuel injection system.

In FIG. 1, a fuel injection system is shown in which a fuel injector 1 that has a pressure booster device 7 communicates with a high-pressure fuel source 2 via a fuel line 4 that is provided with a throttle 3. The high-pressure fuel source includes a plurality of elements not shown in detail, such as a fuel tank, a pump, and the high-pressure rail of a common rail system known per se; the pump furnishes a fuel pressure of up to 1600 bar to the high-pressure rail by pumping fuel from the tank into the high-pressure rail. A separate injector supplied from the high-pressure rail is provided for each cylinder of the engine. The injector 1 shown as an example in FIG. 1 has a fuel injection valve 6, with a closing piston 13 that with its injection openings 9 protrudes into the combustion chamber 5 of a cylinder of an internal combustion engine. The closing piston 13 is surrounded at a pressure shoulder 16 by a pressure chamber 17, which communicates with the high-pressure chamber 28 of the pressure booster device 7 via a high-pressure line 40. The closing piston 13, on its end remote from the combustion chamber, that is, in its guide region 14, protrudes into a closing pressure chamber 12, which can be made to communicate with a return chamber 27 of the pressure booster device via a line 41 and with the high-pressure fuel source 2 via a fuel line 42, 45, connected to the return chamber 27, and a 3/2-port directional control valve 8. In a first position, the valve 8 connects the line 42 with the line 45, while a low-pressure line 44 leading to a low-pressure system, not shown in detail, is closed on its end connected to the valve 8. In a second position of the valve, the line 42 leading to the return chamber 27 or the closing pressure chamber 12 communicates with the low-pressure line 44, while the end of the line 45 remote from the high-pressure fuel source 2 and connected to the valve is sealed off. The closing piston is resiliently supported via a restoring spring 11, disposed in the closing pressure chamber and tensed between the housing 10 of the injection valve 6 and the closing piston 13; the restoring spring presses the needle region 15 of the closing piston against the injection openings 9. The pressure booster device 7 has a resiliently supported pressure booster piston 21, which disconnects the high-pressure chamber 28 that communicates with the high-pressure line 40 from a chamber 26 which is connected to the high-pressure fuel source 2 via the line 4. The spring 25 used to support the piston is disposed in the return chamber 27 of the pressure booster device. The piston 21 is embodied in two parts and has a first partial piston 22 and a smaller-diameter second partial piston 23. The housing 20 of the pressure booster device is divided by the partial piston 22, disposed displaceably in the housing, into two regions which are disconnected in fluid-tight fashion from one another except for leakage losses. One region is the chamber 26 that communicates with the high-pressure source; the second region has a stepped taper. It includes the second partial piston 23, which plunges displaceably into the taper and demarcates it in fluid-tight fashion from the rest of the second region, which latter forms the return chamber 27. The region defined by the partial piston 23 in the taper forms the high-pressure chamber 28 of the pressure booster device, which chamber communicates with the pressure chamber 17 of the injection valve and communicates via a check valve 29 and a fuel line 43 with the line 4 that leads to the high-pressure fuel source 2. The two partial pistons are separate components but can also be embodied as joined solidly to one another. The second partial piston 23, on its end toward the first partial piston, has a spring retainer 24 protruding beyond its diameter, so that the restoring spring 25 tensed against the housing 20 presses the second partial piston against the first partial piston.

The pressure of the high-pressure fuel source 2 is carried to the injector via the line 4. In the first position of the valve 8, the injection valve is not triggered, and no injection occurs. The rail pressure then prevails in the chamber 26, at the valve 8, in the return chamber 27 via the valve 8 and the line 42, in the closing pressure chamber 12 via the valve and the line 41, and in both the high-pressure chamber 28 and the pressure chamber 17 via the line 43. Thus all the pressure chambers of the pressure booster device are subjected to rail pressure, and the pressure booster piston is pressure-equalized; that is, the pressure booster device is deactivated, and no pressure boost takes place. In this state, the pressure booster piston is restored to its outset position via a restoring spring. The high-pressure chamber 28 is filled with fuel via the check valve 29. Because of the rail pressure in the closing pressure chamber 12, a hydraulic closing force is brought to bear on the closing piston. In addition, the restoring spring 11 furnishes a closing spring force. The rail pressure can therefore prevail constantly in the pressure chamber 17, without unwanted opening of the injection valve. The metering of the fuel into the combustion chamber 5 is effected by activation of the 3/2-port directional control valve 8, or in other words by switching the valve to its second position. As a result, the return chamber 27 is disconnected from the high-pressure fuel source and made to communicate with the return line 44, and the pressure in the return chamber drops. This activates the pressure booster device; the two-part piston compresses the fuel in the high-pressure chamber 28, so that in the pressure chamber 17 that communicates with the high-pressure chamber, the pressure force acting in the opening direction rises. At the same time, upon the switching of the valve to its second position, the fuel pressure in the closing pressure chamber 12 drops, so that the pressure force acting on the closing piston in the closing direction decreases. The value of the fuel pressure in the pressure chamber 17 that is required to open the injection valve accordingly drops precisely at the instant when the opening of the injection valve is to occur, and the needle region 15 of the closing piston already uncovers the injection openings 9 at a lower pressure in the pressure chamber 17 than would be the case if the pressure in the closing pressure chamber 12 were to remain constant. As long as the return chamber 27 is pressure-relieved, the pressure booster device remains activated and compresses the fuel in the high-pressure chamber 28. The compressed fuel is carried onward to the injection openings and injected into the combustion chamber. For terminating the injection, the valve 8 is returned to its first position again. This disconnects the return chamber 27 and the pressure chamber 17 from the return line 44 and connects them again to the supply pressure of the high-pressure fuel source, that is, to the high-pressure rail of the common rail system. As a result, the pressure in the high-pressure chamber drops to rail pressure, and since rail pressure again prevails in the pressure chamber 17 as well, the closing piston is hydraulically balanced and is closed by the force of the spring 11, as a result of which the injection event is ended. After a pressure equalization of the system, the pressure booster piston is returned by a restoring spring to its outset position, and the high-pressure chamber 28 is filled from the high-pressure fuel source via the check valve 29 and the line 43.

In an alternative embodiment, the closing pressure chamber can communicate with the valve 8 directly via a fuel line, instead of indirectly via the return chamber 27 of the pressure booster device; that is, instead of a line 41 communicating with the return chamber, a line is provided that leads directly from the closing pressure chamber to the valve 8.

Figure 2:
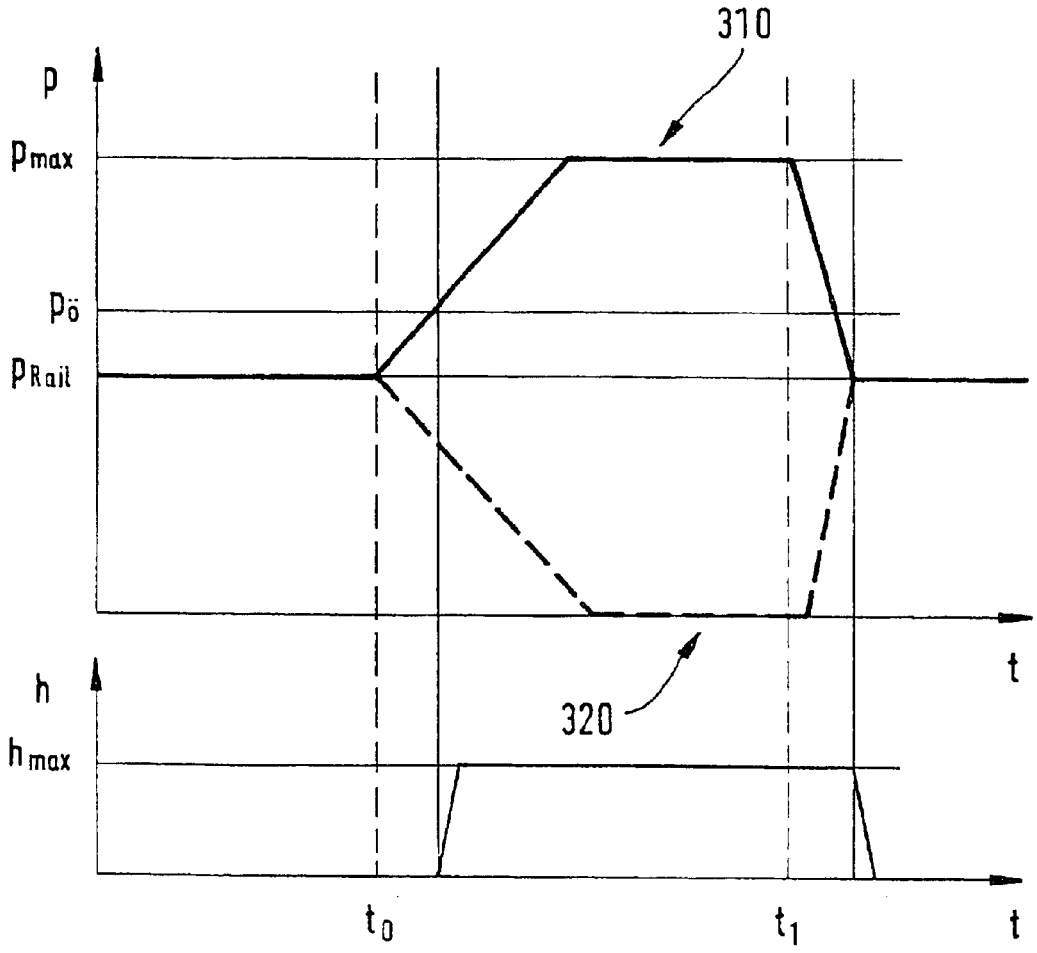
FIG. 2 shows two graphs.

FIG. 2 illustrates the course of the fuel pressures p as a function of the time t as well as the resultant stroke h of the closing piston during one injection cycle. The pressure of the high-pressure fuel source is designated by the symbol $p_{Rail}$, and the pressure in the pressure chamber 12 at which the injection valve opens is designated $p_o$. The maximum stroke path of the injection valve is abbreviated $h_{max}$, and the maximum fuel pressure attainable in the high-pressure chamber 28 is abbreviated $p_{max}$. The curve 310 shows the course over time of the fuel pressure in the high-pressure chamber and in the pressure chamber, while curve 320 illustrates the pressure course in the closing pressure chamber.

If at time $t_0$ the valve is switched from the first position to the second position, the pressure 310 in the high-pressure chamber and in the pressure chamber increases, beginning at the pressure of the high-pressure fuel source, up to the maximum attainable pressure $p_{max}$, which is predetermined by the ratio of the cross-sectional areas of the two partial pistons and the pressure of the high-pressure fuel source. At the same time, the pressure 320 in the closing pressure chamber drops to a lower pressure value (to the fuel pressure prevailing in the low-pressure system, not shown in detail). The injection valve opens; that is, the stroke value h changes from zero to the value $h_{max}$ as soon as the pressure forces in the pressure chamber 17 acting in the opening direction overcompensate for the sum of the pressure force acting in the closing direction in the closing pressure chamber 12 and the force of the restoring spring 11. This is the case when the fuel pressure in the pressure chamber (see pressure course 310) assumes the value $p_{\ddot{o}}$. At a later time $t_1$, the valve 8 is returned to its first position, and as a result the fuel pressures in the pressure chamber and the closing pressure chamber approach one another, until both of them again reach the value of the fuel pressure of the high-pressure fuel source. The valve closes again; that is, the stroke value h again assumes the value of zero.

Figure 3:
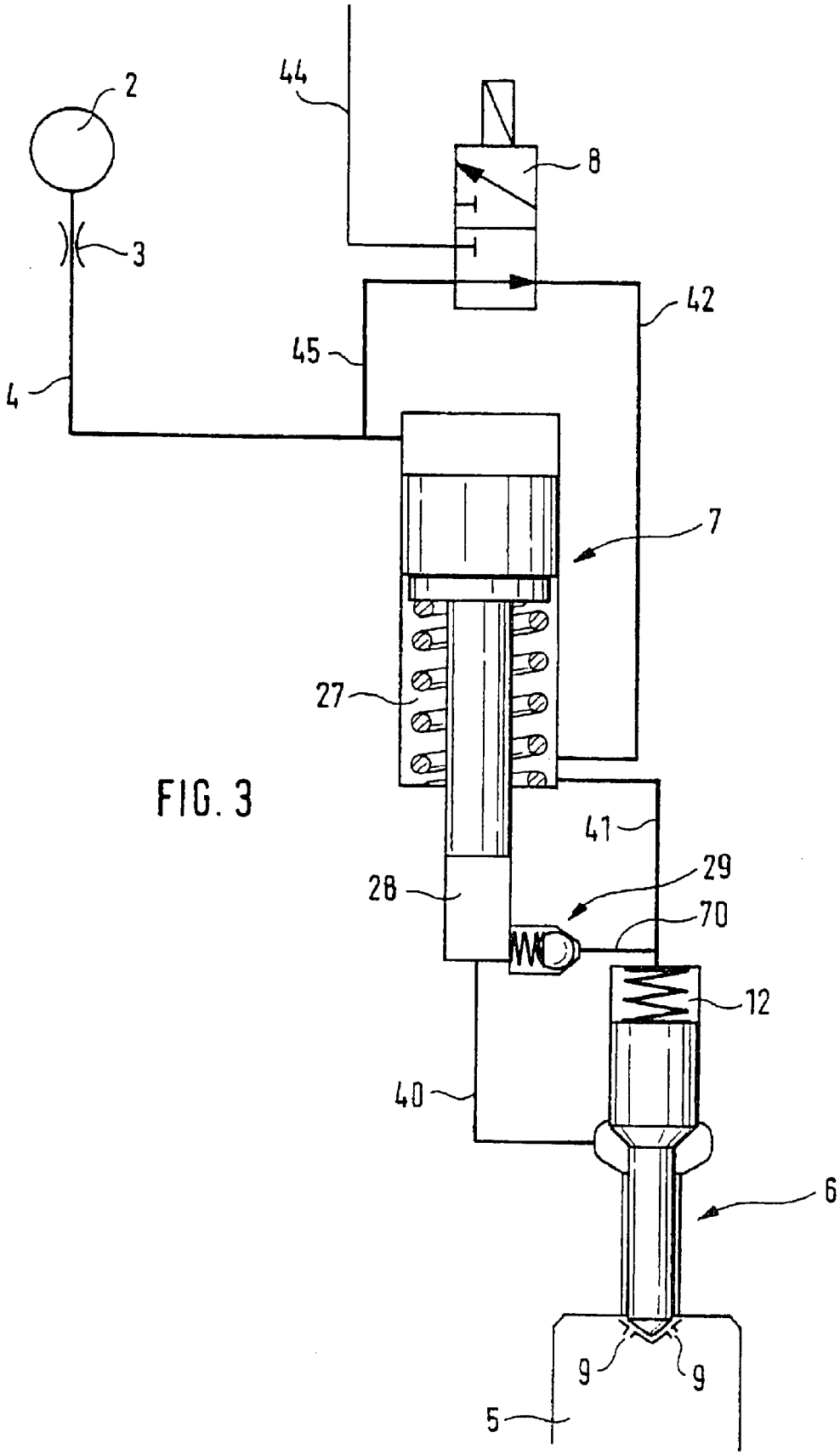
FIG. 3 shows a second fuel injection system.

FIG. 3 shows a fuel injection system in which identical components are identified by the same reference numerals as in FIG. 1. Unlike FIG. 1, the check valve communicates not with the high-pressure fuel source via a line 43, but with the line 41 via a line 70.

Unlike FIG. 1, the filling of the high-pressure chamber upon switching of the valve 8 from the second position to the first position is not effected directly from the high-pressure fuel source but rather from the return chamber 27 and/or the closing pressure chamber 12.

In further alternative versions, the line 70 can communicate, instead of with the line 41, directly with the return chamber 27 or with the closing pressure chamber 12.

Figure 4:
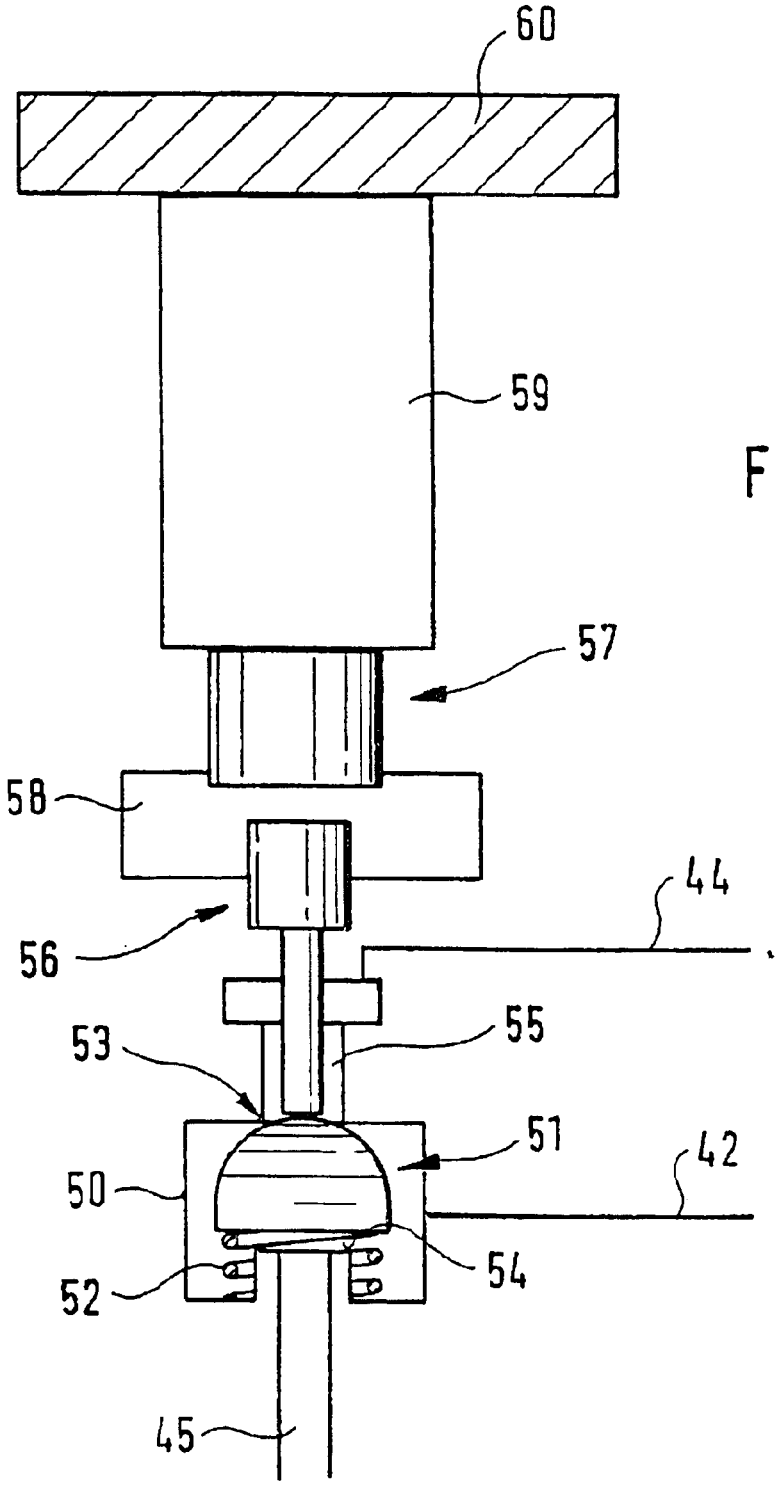
FIG. 4 shows a piezoelectric valve.

The 3/2-port directional control valve 8 included in the arrangements of FIGS. 1 and 3 can be embodied as either a magnetically or a piezoelectrically triggerable valve as in FIG. 4. In the piezoelectric version of FIG. 4, a valve housing 50 communicates with the three connecting lines 42, 44 and 45 known from FIGS. 1 and 3. In the valve housing there is a movably supported valve body 51, which in the position of repose shown is pressed via a restoring spring 52, which is tensed between it and the valve housing, with its hemispherical side face against the first valve seat 53 in a fluid-sealing manner. The opposed side of the valve body, which is formed by a flat face, faces the second valve seat 54 that communicates with the line 45. In the position of repose shown, there is an interstice between the valve body and the second valve seat. A tube 55 leads away from the first valve seat 53, and the low-pressure line 44 is connected to its end remote from the valve body. A first force-transmitting piston 56 rests on the hemispherical side face of the valve body that seals off the tube and protrudes outward from the tube through a sealed-off opening in the side wall of the tube remote from the valve body, so that a force can be exerted on the valve body from outside the valve housing by displacement of the force-transmitting piston. A widened end piece of the piston 56 protrudes into a schematically illustrated coupling chamber 58 that is filled with coupler fluid. On the opposite side of the coupling chamber, a second force-transmitting piston 57 protrudes into the coupling chamber. This latter piston is secured to an electrically triggerable piezoelectric actuator 59, which can change its length when an electrical voltage is applied; a bottom element 60 secured to the opposite side of the piezoelectric actuator is spaced apart by the same distance from the coupling chamber in every electrical state of the piezoelectric actuator.

The position shown for the valve body is the first position of the 3/2-port directional control valve. In this state, the valve body closes the communication of the tube with the chamber in which the valve body is movably supported, so that the line 42 can exchange fuel only with the line 45. If the valve is to be switched into its second position, for the sake of performing a metering of fuel into the combustion chamber, then the piezoelectric actuator 59 must be triggered electrically. To compensate for temperature-dictated changes in length of the piezoelectric actuator and, given a suitable embodiment of the only schematically shown coupling chamber 58, to boost the force/travel as well, the piezoelectric actuator is in contact with the force-transmitting piston 56 via the force-transmitting piston 57 and the coupling chamber 58. If the piezoelectric actuator is triggered, it lengthens, and through the coupling chamber a force is transmitted to the valve body that lifts it from the first valve seat and presses it against the second valve seat, so that now instead of the line 44, it is the line 45 that communicates with the line 42.

The piezoelectric valve can communicate, as shown in FIGS. 1 and 3, with the line 4 by means of the line 45. Alternatively, instead of communicating with the line 4, the valve can also communicate directly with the chamber 26.

Figure 5:
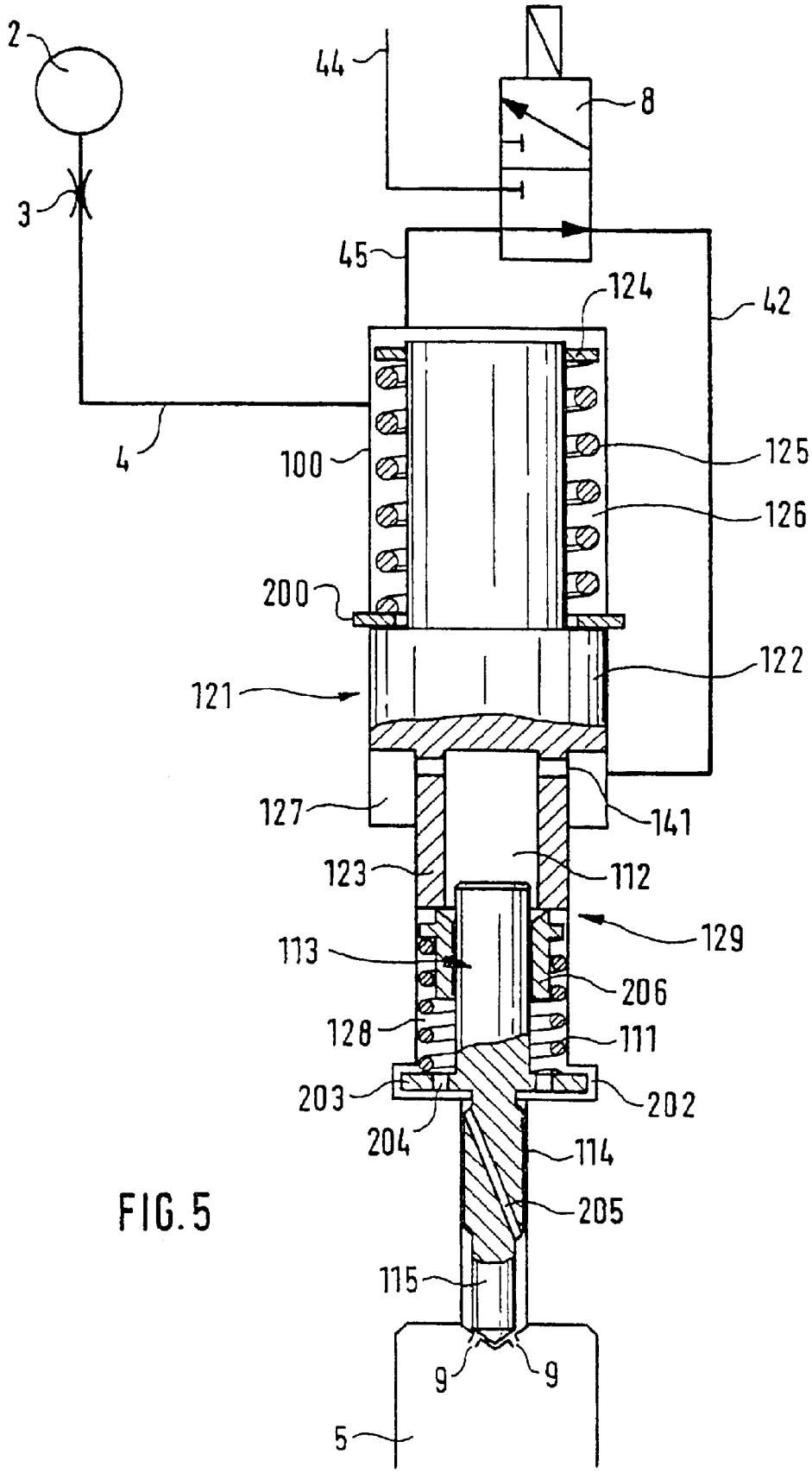
FIG. 5 shows a further fuel injection system.

FIG. 5 shows a further version, with a pressure booster device integrated with the injector housing 100. Components identical to those shown in FIGS. 1 and 3 are provided with the same reference numerals and will not be described again. In the injector housing, three parts movable relative to one another are supported resiliently: a pressure booster piston 121, a closing piston 113, and a hollow valve piston 206. The pressure booster piston 121 has a first partial piston 122 and a second partial piston 123. The first partial piston 122 is guided axially by the injector housing in a fluid-tight fashion, except for leakage losses. On one side, the first partial piston has a stepped taper, so that there is space between the injector housing and the first partial piston for the restoring spring 125 of the pressure booster device. The restoring spring 125 is fastened between a spring retainer 124, disposed at the taper, and a limiting element 200 secured to the injector housing; the side of the limiting element remote from the restoring spring acts as a stop for the pressure booster piston, to prevent the taper of the first partial piston from striking the injector housing. The chamber 126 between the first partial piston and the injector housing in which the restoring spring 125 is located corresponds to the chamber 26 of FIG. 1 and like it communicates with the high-pressure fuel source 2 via the line 4. The first partial piston 122, on the side remote from the chamber 126, changes over into the smaller-diameter second partial piston 123, which in some regions is also guided by the injector housing, since this housing has a stepped taper in the region of the second partial piston. The space between the second partial piston and the injector housing forms the return chamber 127 of the pressure booster device, which via bores 141 communicates in the second partial piston with the latter's hollowed-out inner region that forms the closing pressure chamber 112. The closing piston 113 protrudes into the closing pressure chamber; the opposite end of the closing piston, that is, the needle region 115, closes the injection openings 9. The guide region 114 of the closing piston, which assures axial guidance of the closing piston along the injector housing, is located between the region of the closing piston that protrudes into the closing pressure chamber and the needle region. The guide region is larger in diameter than the needle region. The guide region has a flow connection 205, for instance in the form of a continuous bore, so that the interstice between the needle region and the injector housing and the smaller-diameter region of the closing piston that adjoins the guide region on the far side of the needle region can exchange fuel with one another. A circular-annular piece 203 is mounted on the circumference of the closing piston between the guide region 114 and the region of the closing piston that protrudes into the closing pressure chamber; this circular-annular piece protrudes into a cylindrically symmetrical bulge 202 in the injector housing, but without being able to touch the housing. The circular-annular piece 203 serves to brace the restoring spring 111, which presses the closing piston against the injection openings. To that end, the restoring spring 111 rests on a radial protrusion of the hollow valve piston 106, which is guided by the closing piston and does not touch the injector housing. The hollow valve piston has one end that tapers to a point forming a circular sealing edge and that is pressed by the restoring spring 111 against the face end of the second partial piston, so that the high-pressure chamber 128, which is formed by the space located on the far side of the hollow valve piston between the closing piston and the injector housing, can be sealed off from the closing pressure chamber 112; that is, the hollow valve piston together with the face end of the second partial piston can act as a check valve 129. Bores 204 are made in the circular-annular piece 203 that reinforce the fuel exchange between the regions of the high-pressure chamber on either side of the circular-annular piece. Between the circular-annular piece and the end toward the injection openings of the needle region, the closing piston has two regions with a diameter that is less than the diameter in the portion protruding into the closing pressure chamber; these are first, a waist between the guide region and the circular-annular piece, and second, the region between the guide region and the end of the closing piston toward the injection openings.

In the arrangement of FIG. 5, the high-pressure chamber 28 and the pressure chamber 17 of the arrangement of FIG. 1 coincide and are formed by the high-pressure chamber 128. Otherwise, the mode of operation is similar to that of the arrangement of FIG. 1. The check valve for filling the high-pressure chamber 128 is formed by the above-described check valve 129. The metering of the fuel into the combustion chamber 5 is again effected by activation of the 3/2-way control valve 8. As a result, the return chamber 127 and the closing pressure chamber 112 are pressure-relieved and the pressure booster is activated. The fuel in the high-pressure chamber 128 is compressed and carried on to the tip of the injector via the flow connection 205. Because of the pressure drop in the closing pressure chamber, the pressure required to lift the closing piston drops to below the value that would be required if the pressure in the closing pressure chamber remained constant. Thus finally, because of the rising opening pressure force in the high-pressure chamber and the simultaneously dropping closing pressure force in the closing pressure chamber, the closing piston uncovers the injection openings, and the fuel is injected into the combustion chamber. In this situation, the hollow valve piston 206 seals the high-pressure chamber 128 off from the closing piston with a guide; the hollow valve piston is axially displaceable and during the compression of the fuel in the high-pressure chamber moves together with the pressure booster piston toward the injection openings. As already explained, with its sealing seat, the hollow valve piston also seals off the high-pressure chamber from the second partial piston. This assures that compressed fuel cannot flow back into the closing pressure chamber. For terminating the injection, the return chamber 127 is disconnected from the line 44 by the control valve 8 and made to communicate with the high-pressure fuel source 2, as a result of which the rail pressure builds up in the return chamber and in the closing pressure chamber, and the pressure in the high-pressure chamber drops to the rail pressure. The closing piston is now hydraulically balanced and is closed by the force of the restoring spring 111, which ends the injection event. As a consequence of the pressure equalization, the pressure booster piston 121 is now also returned to its outset position by the restoring spring 125, and the high-pressure chamber 128 is filled from the closing pressure chamber 112, or return chamber 127, via the check valve 129.

For stabilizing the switching sequences, additional structural provisions can be made for damping any fluctuations that may occur between the high-pressure fuel source and the injector. Besides a suitable design of the throttle 3, it is also possible alternatively or in combination to install throttle check valves at an arbitrary point in the supply lines 4, 42 and 45. The bores 204 can also be omitted. Moreover, the pressure booster piston, closing piston and hollow valve piston can also have shapes that differ from those described. What is essential in the closing piston is only that first, fuel delivery as far as the injection openings is assured and that second, in the region of the high-pressure chamber, the fuel pressure finds an engagement face that effectively leads to an axial force on the closing piston that is oriented toward the pressure booster piston, or in other words that acts in the opening direction.

In all the exemplary embodiments, the closing pressure chamber 12 and 112 and the return chamber 27 and 127 are realized by a common closing pressure return chamber (12, 27, 41) and (112, 127, 141); all the portions (12, 27) and (112, 127), respectively, of the closing pressure return chamber communicate permanently with one another for exchanging fuel, for instance via at least one fuel line 41 or via at least one bore 141 integrated with the pressure booster piston. The pressure chamber 17 and the high-pressure chamber 28 can moreover be formed by a common injection chamber (17, 28, 40), and all the portions of the injection chamber communicate with one another permanently for exchanging fuel. The pressure chamber 17 and the high-pressure chamber 28 may communicate with one another via a fuel line 40 (see FIGS. 1 and 3), or the pressure chamber can be formed by the high-pressure chamber (128) itself (see FIG. 5).

Figure 6:
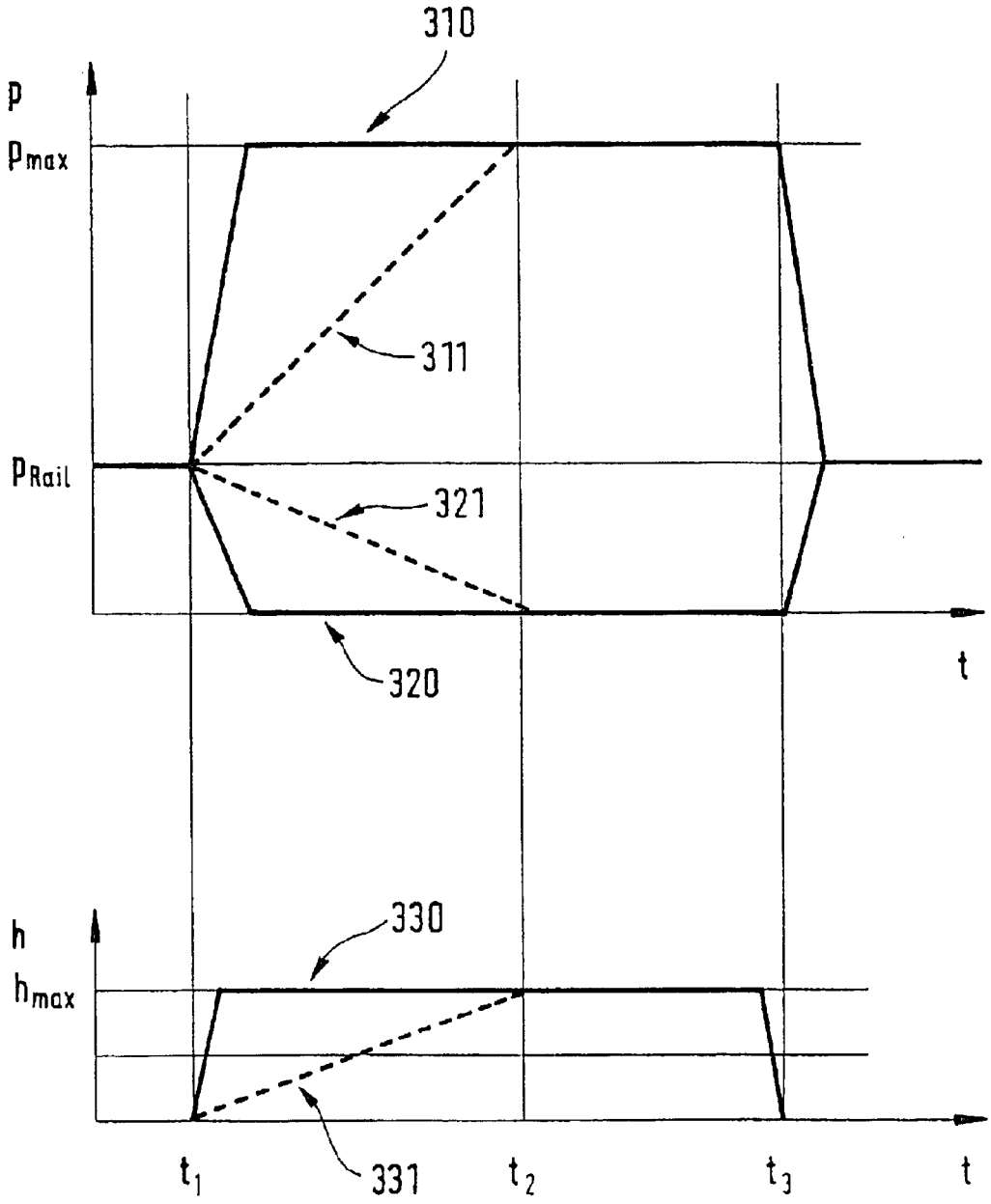
FIG. 6 shows graphs of pressure ratios for various switching speeds.

FIG. 6 shows the courses over time of the fuel pressure p in the high-pressure chamber 28 and 128 for various switching speeds of the 3/2-way piezoelectric valve of FIG. 4. The curve 310 represents the pressure ratios upon fast actuation of the piezoelectric valve, while the curve 311 shows it in the case of slow valve actuation. The first position of the valve, in which the valve body is pressed against the first valve seat 53, will hereinafter be called the position of repose, and the second position, in which the valve body is pressed against the second valve seat 54, will be called the terminal position. In the case of fast valve actuation, the piezoelectric valve is triggered electrically in such a way that the valve body rapidly moves from the position of repose to the terminal position, while in the case of slow valve actuation, the electrical voltage applied to the piezoelectric actuator is increased slowly, so that the valve body moves from the position of repose to the terminal position at a low speed. The curves 320 and 321 show the associated pressure courses in the return chamber of the pressure booster as a function of the time t. The resultant stroke h of the piezoelectric actuator, that is, the motion of the valve body, is plotted in curves 330 and 331. The symbol $p_{Rail}$ designates the pressure of the high-pressure fuel source, that is, the pressure in the high-pressure rail of the common rail system; $p_{max}$ is the maximum fuel pressure attainable in the high-pressure chamber; and $h_{max}$ is the maximum stroke of the valve body.

In the position of repose of the valve body, the pressure booster is deactivated, and the piston of the pressure booster is returned to its outset position; no injection takes place. Both in the high-pressure chamber and in the return chamber, rail pressure $p_{Rail}$ prevails (see the curves 310, 311, 320 and 321 in the time period from zero to time $t_1$). In the terminal position $h_{max}$ of the valve body, the pressure booster is fully activated; the pressure in the return chamber drops to a low value near zero, and the pressure in the high-pressure chamber reaches its maximum value $p_{max}$. The closing piston is lifted, and an injection takes place. In a transitional region between the position of repose and the terminal position, the pressure booster here is partly activated; the pressure in the return chamber decreases with an increasing stroke of the piezoelectric valve, and the pressure booster piston generates a medium injection pressure, which rises with an increasing valve stroke, so that the injection proceeds with a rising pressure. In the graphs shown in FIG. 6, for the sake of simplification, it is assumed that the nozzle opening pressure differs only insignificantly from the rail pressure. Upon slow actuation of the valve from time $t_1$ (curve 331) on, the pressure in the return chamber drops continuously until time $t_2$ to a low value (curve 321), while in the pressure in the high-pressure chamber rises slowly (curve 311) to the value $p_{max}$. When the nozzle opening pressure is reached shortly after $t_1$, the closing piston lifts from the injection openings and opens completely, so that with increasing pressure an increasing quantity of fuel is injected. At time $t_2$, the maximum opening stroke $h_{max}$ of the valve body and the maximum injection pressure $p_{max}$ are attained. The closing event at time $t_3$ is fast, in order to assure a fast pressure reduction at the end of injection (the professional term for this in English is "rapid spill"). Thus at time $t_3$, when the lengthening of the piezoelectric actuator is reversed, the pressure in both the high-pressure chamber and the return chamber is returned to the rail pressure level, and the closing piston closes the injection openings again. If conversely at time $t_1$ the valve is triggered quickly (curve 330), then the transitional region is rapidly traversed, and the pressure in the high-pressure chamber rises to the maximum level $p_{max}$ (see curve 310) considerably earlier than time $t_2$, while at the same time the pressure in the return chamber rapidly drops to a lower value (see curve 320). Accordingly, a quasi-rectangular pressure course 310 results. The closing event is preferably fast, analogously to the case described above, in order to assure a fast pressure reduction at the end of injection.

Figure 7:
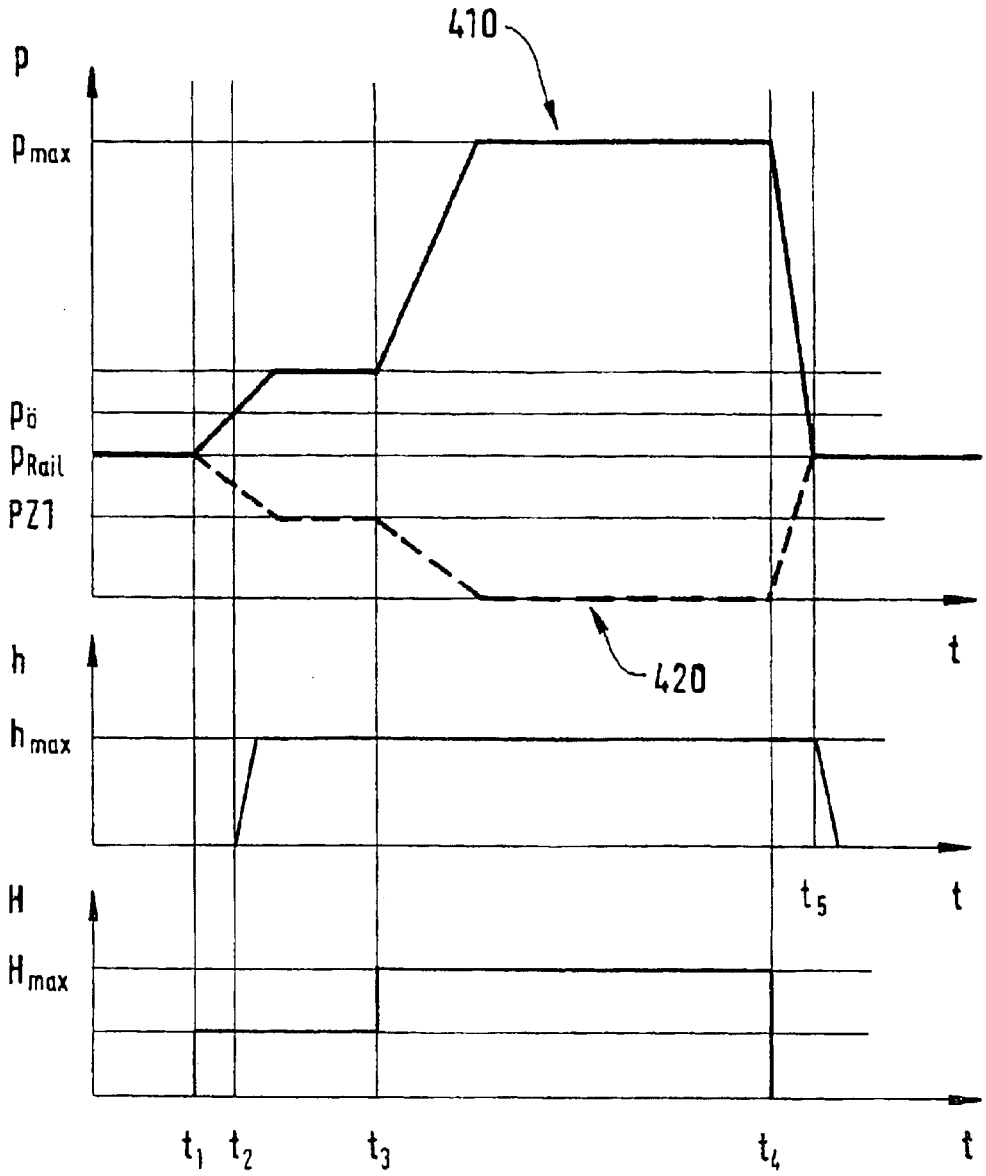
FIG. 7 illustrates the switching states when a 3/3-port directional control valve is used.

FIG. 7 shows the pressure ratios for the case where the piezoelectric valve of FIG. 4 is operated as a 3/3-port directional control valve, for instance. Besides the position of repose and the terminal position, the valve body of this valve also has a middle position, in which it can remain for at least a certain length of time, and in which the line 42 communicates with both the line 45 and the line 44. Then in this period of time a pressure equilibrium at an intermediate pressure level PZ1 can be established in the return chamber; this level is determined by the outflowing quantity into the low-pressure system and the inflowing quantity from the high-pressure fuel source, taken together. The curve 410 shows the pressure course in the high-pressure chamber, and the curve 420 shows the pressure course in the return chamber. In the h(t) graph shown below, the course over time of the stroke of the closing piston is shown, while in the third graph, the course over time of the piezoelectric stroke H, that is, the motion of the valve body, is plotted. The symbol $H_{max}$ designates the maximum value for the piezoelectric stroke, with which the terminal position of the valve body in which the return chamber now communicates with only the low-pressure system can be established. The opening pressure $p_{\ddot{o}}$ in the high-pressure chamber is the pressure required to lift the closing piston. The symbols $t_1$ through $t_5$ designate various successive instants within an injection cycle that includes a boot injection, that is, a first injection phase at a low pressure level, and a second injection phase at a high pressure level.

At time $t_1$, the valve body is switched to the middle position by a suitable triggering of the piezoelectric actuator and is kept in this middle position until time $t_3$ (see the H(t) graph). In the return chamber, the pressure drops to the intermediate pressure level PZ1, while the pressure in the high-pressure chamber slowly rises. As soon as it exceeds the opening pressure at time $t_2$, the injector opens (see the h(t) graph), and a boot injection phase takes place at a pressure level between the rail pressure level and the maximum pressure value attainable with the pressure booster. At time $t_3$, the piezoelectric valve is switched into its terminal position (second position) with the stroke value $H_{max}$, so that the pressure in the return chamber drops to a lesser value near zero, while the injection openings continue to remain open and the pressure in the high-pressure chamber rises to the value $p_{max}$. This main injection phase lasts until time $t_4$, when the valve is returned to its position of repose (H=0), so that in the high-pressure chamber and in the return chamber a pressure equalization to the rail pressure level takes place, and a short time later, at time $t_5$, the closing piston closes the injection openings (h=0).

Alternatively, the intermediate position can also be used for an injection at low injection pressure, again proceeding from the intermediate position to the position of repose. This is done for instance when there are small injection quantities involved, of the kind required in a preinjection or during idling.

Figure 8:
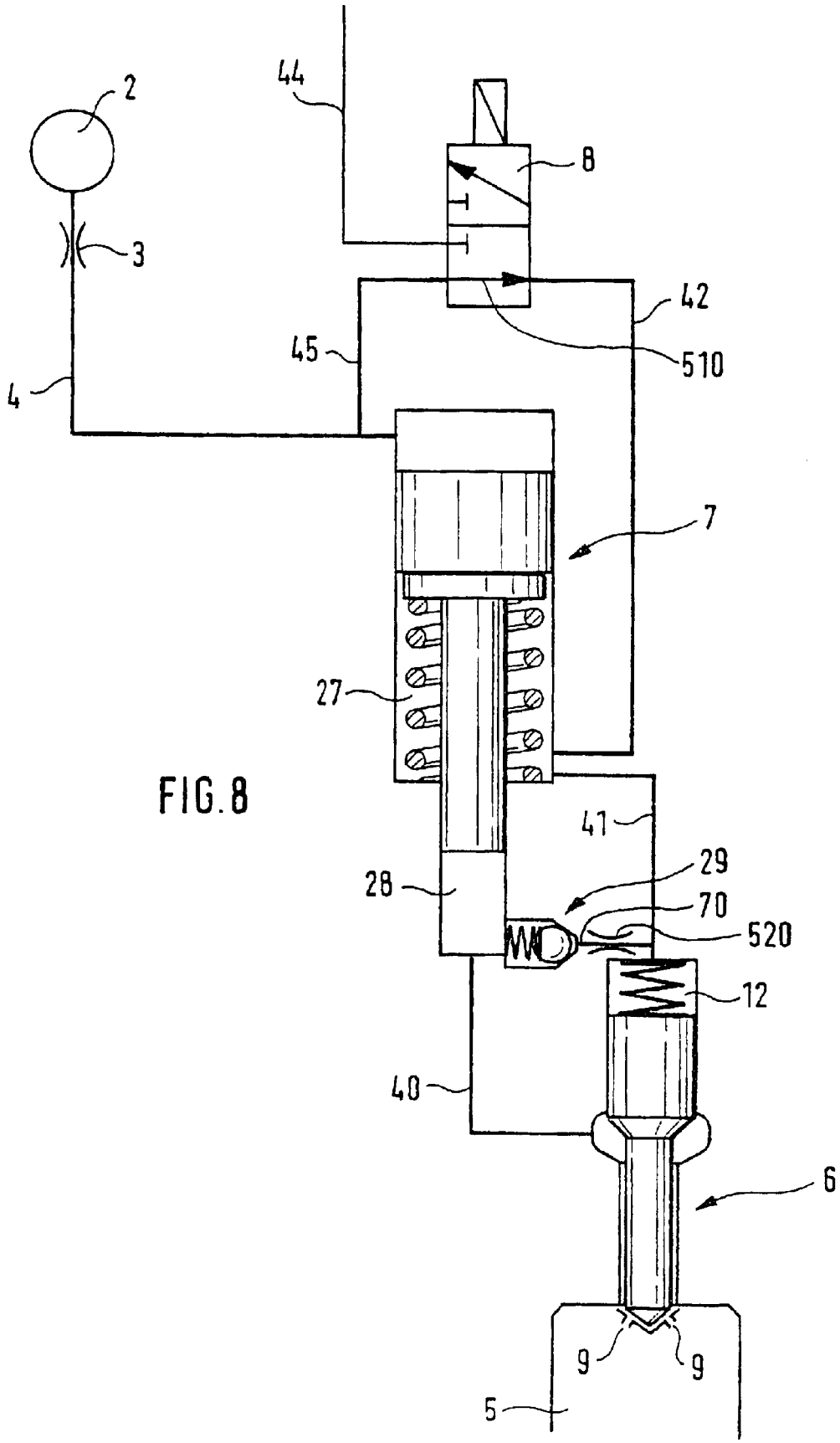
FIG. 8 shows a further fuel injection system.

FIG. 8 shows a modification of the embodiment of FIG. 3, in which with an otherwise identical design, a throttle 520 is additionally installed in the line 70, so that the communication between the high-pressure chamber 28 and the closing pressure chamber 12 or return chamber 27 is throttled. The cross section of the communication path of the 3/2-port directional control valve 8 between the line 45 and the line 42 is identified by reference numeral 510 and will hereinafter be called the valve cross section.

By a suitable adaptation of the valve cross section 510, which connects the return chamber 27 to the pressure supply, and of the flow cross section of the filling path 70 by means of a suitable choice of the flow cross section of the throttle 520, a hydraulic supplementary force for closing the needle can be generated. To that end, by means of the throttle 520, the filling path 70 is designed to be quite small, yet large enough to enable filling of the high-pressure chamber 28 and restoration of the pressure booster piston by the time of the next injection. Moreover, the valve cross section 510 is designed as large enough that a rapid pressure buildup to rail pressure takes place in the return chamber 27; depending on the layout of the lines, an overelevation of pressure can also occur in the return chamber. As a result of the rapid pressure buildup in the return chamber, a rapid pressure drop to rail pressure takes place in the high-pressure chamber 28, with an ensuing underswing of pressure to below rail pressure. The throttle 520 prevents an overly rapid pressure equalization between chamber 28 and chamber 12 or 27. Since in this phase rail pressure continues to prevail in the closing pressure chamber 12, a closing hydraulic force on the nozzle needle occurs.

In a further alternative embodiment, the design of the flow cross section of the filling path 70 is assured not by the use of a throttle but rather by a check valve 29 that has a corresponding flow cross section.

Figure 9:
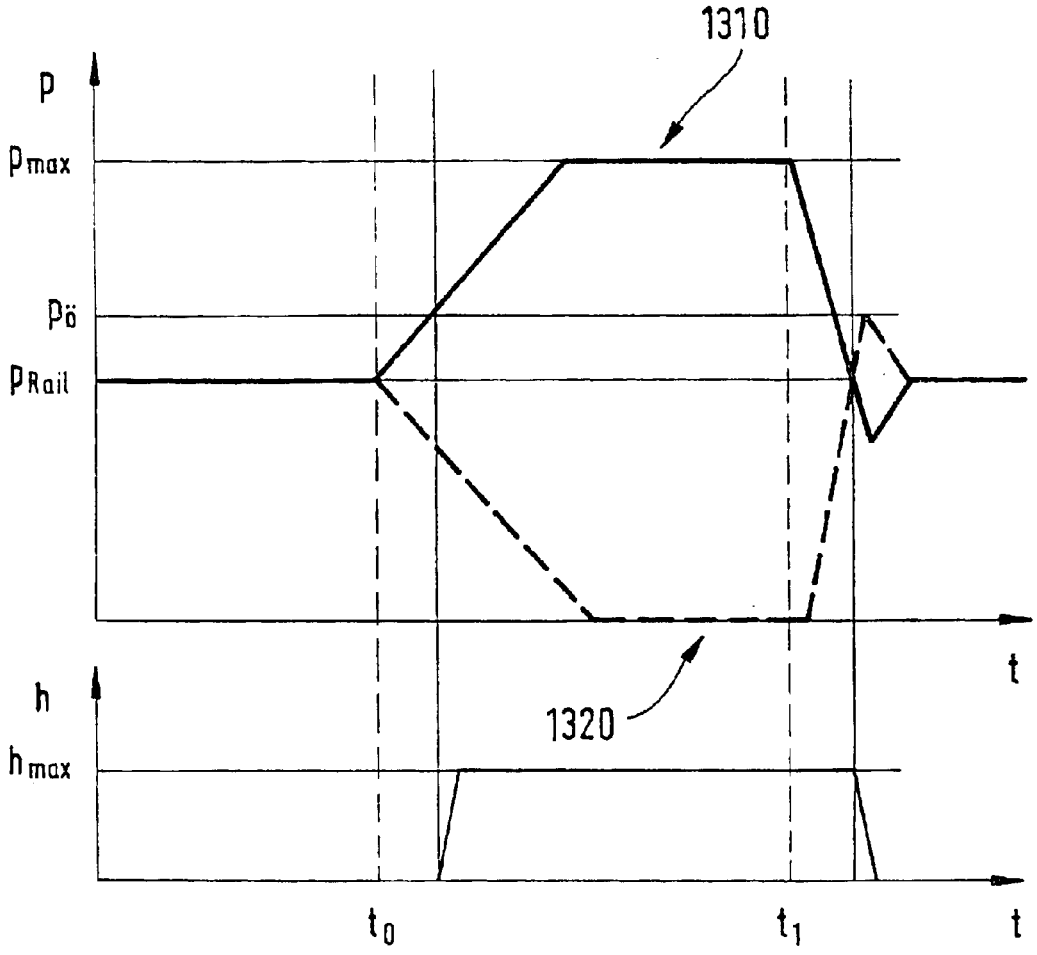
FIG. 9 shows further graphs.

FIG. 9 schematically shows the pressure courses attainable with the arrangement of FIG. 8. Here the course over time of the fuel pressure in the high-pressure chamber 28 is identified by reference numeral 1310; the course over time of the fuel pressure in the return chamber 27 of the pressure booster is identified by reference numeral 1320.

The end of injection is as follows here: After deactivation of the valve 8, a pressure buildup to rail pressure occurs in the return chamber 27 and in the closing pressure chamber 12, and as a result a rapid pressure drop to rail pressure simultaneously occurs in the high-pressure chamber 28. This latter pressure drop takes place so fast that an underswing of the pressure in the high-pressure chamber and in the pressure chamber of the injector to below the rail pressure takes place. Precisely in this phase, the needle closure takes place, so that an additional hydraulic pressure force on the nozzle needle occurs, as a result of which fast needle closure is achieved, and the fuel quantities can be metered even more precisely into the combustion chambers of the engine. As the course continues, the rail pressure is established in the high-pressure chamber and in the pressure chamber as well. The overswing to above the rail pressure shown in the curve 1320 is caused hydraulically and can be minimized or suppressed by means of a suitable layout of lines. What is essential for the fast pressure drop with a subsequent underswing to below rail pressure in the high-pressure chamber is the fast pressure buildup in the return chamber.

Figure 10:
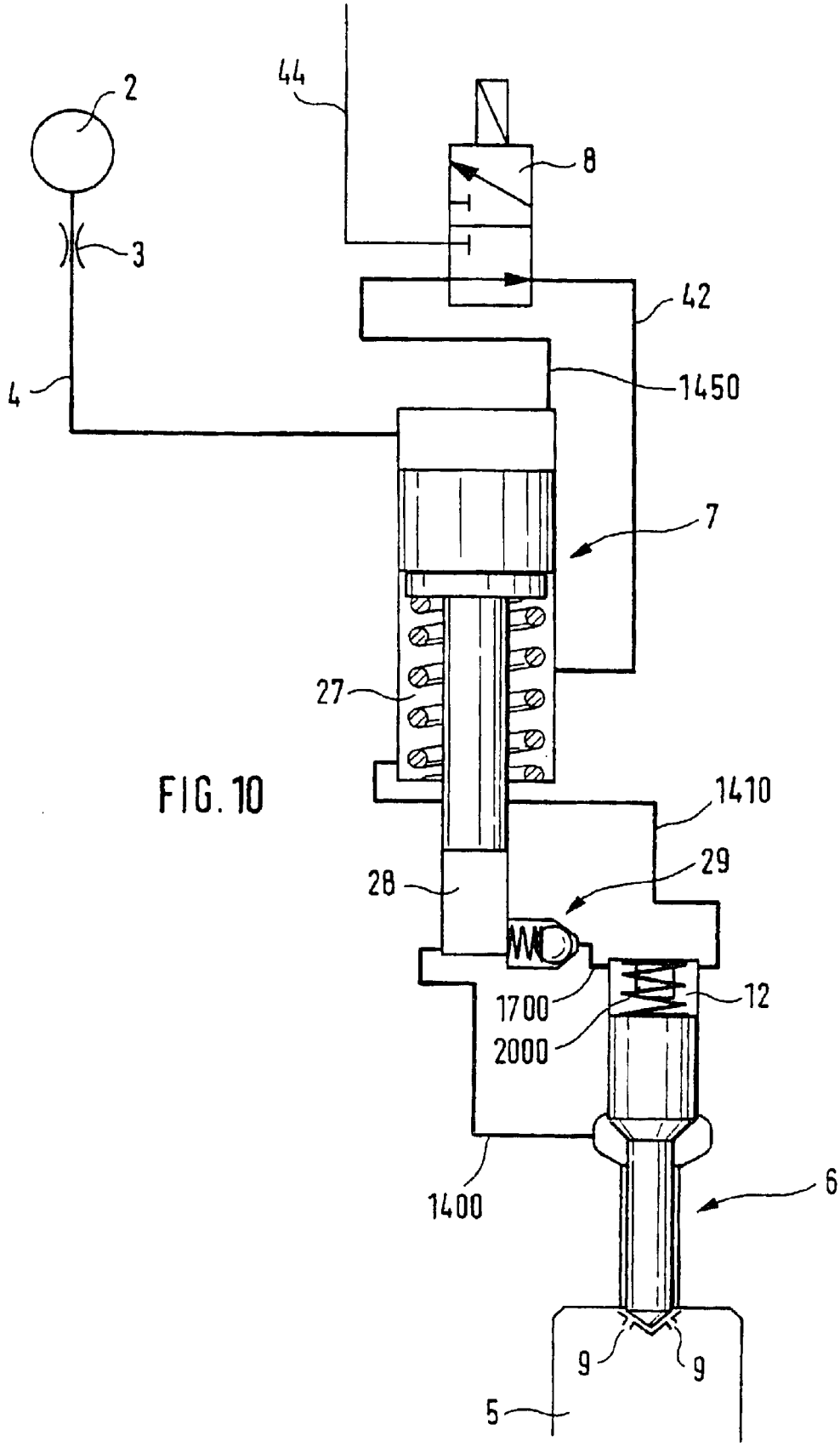
FIG. 10 shows a further alternative embodiment.

FIG. 10 shows a modified embodiment of the arrangement shown in FIG. 3. Here, instead of the line 45, a fuel line 1450 is provided, which does not communicate directly with the line 4 but instead communicates with the chamber of the pressure booster into which the line 4 discharges. The line 1450 discharges into the chamber on the end of the pressure booster chamber opposite the line 4. The line 41 of FIG. 3 is also replaced with a fuel line 1410, which unlike the line 41 of FIG. 3 discharges into the return chamber 27 on the far side of where the line 42 discharges into this return chamber. Also, this line 1410 is connected to the closing pressure chamber 12 in such a way that diametrically opposite it, a line 1700 that replaces the line 70 of FIG. 3 can be secured, discharging into the closing pressure chamber. The other end of the line 1700 communicates with the high-pressure chamber 28 via a check valve 29 in the manner known from FIG. 3. The line 40 of FIG. 3 is also replaced by a line 1400, which discharges diametrically opposite the line 1700, or the check valve 29, into the high-pressure chamber 28. Moreover, unlike the arrangement of FIG. 3, a limiting element 2000 that limits the opening stroke of the injector is secured in the closing pressure chamber.

The mode of operation is essentially the same as that for the arrangement of FIG. 3, except that because of the diametrically opposed disposition of the orifices of the fuel lines in the chambers of the pressure booster and in the closing pressure chamber of the injector, thorough rinsing of all the chambers with fuel is compelled to occur.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for internal combustion engines, having a fuel injector that can be supplied from a high-pressure fuel source, wherein a pressure booster device having a movable pressure booster piston is connected between the fuel injector and the high-pressure fuel source, and the pressure booster piston disconnects a chamber that is connectable to the high-pressure fuel source from a high-pressure chamber communicating with the fuel injector, and by filling a return chamber of the pressure booster device with fuel and by evacuating the return chamber of fuel, the fuel pressure in the high-pressure chamber can be varied, the fuel injector having a movable closing piston for opening and closing injection openings, the closing piston (13; 113) protruding into a closing pressure chamber (12; 112), so that the closing piston can be subjected to fuel pressure to attain a force acting in the closing direction on the closing piston, the closing pressure chamber (12; 112) and the return chamber (27; 127) being formed by a common closing pressure return chamber (12, 27, 41; 112, 127, 141), and all the portions (12, 27; 112, 127) of the closing pressure return chamber communicate (41; 141) permanently with one another for exchanging fuel, a pressure chamber (17; 128) for supplying injection openings with fuel and for exerting a force acting in the opening direction on the closing piston, the high-pressure chamber (28) being in communication (43; 70, 41, 42; 1700, 1410, 42) with the high-pressure fuel source in such a way that in the high-pressure chamber, except for pressure fluctuations, at least the fuel pressure of the high-pressure fuel source can prevail constantly; the pressure chamber and the high-pressure chamber being formed by a common injection chamber; and wherein all the portions of the injection chamber communicate with one another permanently for exchanging fuel.

2. The fuel injection system of claim 1, wherein the pressure chamber (17) and the high-pressure chamber (28) communicate with one another via a fuel line (40).

3. The fuel injection system of claim 1, wherein the pressure chamber is formed by the high-pressure chamber (128).

4. The fuel injection system of claim 1, wherein the closing pressure chamber (12) and the return chamber (27) communicate with one another via a line.

5. The fuel injection system of claim 2, wherein the closing pressure chamber (12) and the return chamber (27) communicate with one another via a line.

6. The fuel injection system of claim 3, wherein the closing pressure chamber (12) and the return chamber (27) communicate with one another via a line.

7. The fuel injection system of claim 1, wherein the closing pressure chamber (112) and the return chamber (127) are demarcated from one another by a partial piston (123) of the pressure booster piston (121), and wherein at least one bore (141) connecting the closing pressure chamber and the return chamber is made in the partial piston.

8. The fuel injection system of claim 2, wherein the closing pressure chamber (112) and the return chamber (127) are demarcated from one another by a partial piston (123) of the pressure booster piston (121), and wherein at least one bore (141) connecting the closing pressure chamber and the return chamber is made in the partial piston.

9. The fuel injection system of claim 3, wherein the closing pressure chamber (112) and the return chamber (127) are demarcated from one another by a partial piston (123) of the pressure booster piston (121), and wherein at least one bore (141) connecting the closing pressure chamber and the return chamber is made in the partial piston.

10. The fuel injection system of claim 1, wherein the high-pressure chamber (28) communicates with the chamber (26) via a check valve (29).

11. The fuel injection system of claim 1, wherein the high-pressure chamber (28; 128) communicates (70) with the closing pressure chamber (12; 112).

12. The fuel injection system of claim 11, wherein the communication (70) includes a check valve (29; 129).

13. The fuel injection system of claim 11, wherein the communication between the high-pressure chamber (28) and the closing pressure chamber (12) is throttled (520; 29) in such a way that during a closing event, the pressure in the pressure chamber can underswing to below the pressure of the high-pressure fuel source.

14. The fuel injection system of claim 12, wherein the communication between the high-pressure chamber (28) and the closing pressure chamber (12) is throttled (520; 29) in such a way that dining a closing event, the pressure in the pressure chamber can underswing to below the pressure of the high-pressure fuel source.

15. The fuel injection system of claim 1, wherein the return chamber (27; 127) can be made to communicate via a valve (8) selectively with a low-pressure line (44) or with the high-pressure fuel source (2).

16. The fuel injection system of claim 15, wherein the valve is a piezoelectric valve that has a first and a second position, and wherein the piezoelectric valve connects the return chamber to the high-pressure fuel source, in a first position, and to the low-pressure line (44), in a second position.

17. The fuel injection system of claim 16, wherein the piezoelectric valve is embodied such that the speed of the transition between the first position and the second position can be varied.

18. The fuel injection system of claim 15, wherein the piezoelectric valve can be switched into at least one intermediate position, so that an intermediate pressure level results in the return chamber.

19. The fuel injection system of claim 18, wherein the piezoelectric valve in the intermediate position connects the return chamber with both the high-pressure fuel source and the low-pressure line.

20. The fuel injection system of claim 1, wherein in at least one of the chambers (26, 27, 28) of the pressure booster device and/or in the closing pressure chamber (12) of the fuel injector, lines (4, 1450; 42, 1410; 1410, 1700; 1700, 29, 1400) are disposed in the chamber or chambers in such a way, in particular being disposed diametrically oppositely, that upon a fuel flow in the lines, thorough rinsing of the chamber or chambers with fuel is compelled to occur.

* * * * *